US011490729B2

(12) United States Patent
Smart

(10) Patent No.: US 11,490,729 B2
(45) Date of Patent: Nov. 8, 2022

(54) CYLINDRICAL STOP ASSEMBLY

(71) Applicant: Shannon Smart, Colorado Springs, CO (US)

(72) Inventor: Shannon Smart, Colorado Springs, CO (US)

( * ) Notice: Subject to any disclaimer, the term of this patent is extended or adjusted under 35 U.S.C. 154(b) by 0 days.

(21) Appl. No.: 17/166,123

(22) Filed: Feb. 3, 2021

(65) Prior Publication Data

US 2022/0240674 A1 Aug. 4, 2022

(51) Int. Cl.
*A47B 88/988* (2017.01)
*A47B 88/994* (2017.01)

(52) U.S. Cl.
CPC ..... *A47B 88/988* (2017.01); *A47B 88/994* (2017.01)

(58) Field of Classification Search
CPC ..... A47B 88/994; A47B 88/988; A47B 88/90; A47B 88/931; A47B 88/969; A47B 88/975; A47B 57/585; A47B 57/583; A47B 57/586; A47B 57/58
See application file for complete search history.

(56) References Cited

U.S. PATENT DOCUMENTS 536,272 A * 3/1895 Edsall ..... A47H 1/022 211/105.6
1,425,247 A * 8/1922 Galbreath ..... A47H 1/022 211/105.6
1,639,551 A * 8/1927 Booth ..... A47H 1/022 211/105.6
2,032,842 A * 3/1936 Gould ..... A47H 1/022 211/105.6
2,746,457 A 5/1956 Musacchia
2,973,870 A * 3/1961 Schoos ..... A47H 1/022 211/123
3,040,902 A * 6/1962 Dunn ..... A47H 1/102 211/105.4
3,572,511 A * 3/1971 Triplett ..... F16B 9/056 211/105.6
4,081,100 A 3/1978 Presby
4,118,087 A * 10/1978 Dorf ..... A47B 45/00 211/105.6
5,111,959 A 5/1992 Glickman
5,303,832 A * 4/1994 Tu ..... A47B 96/1425 211/105.4
6,651,831 B2 * 11/2003 Samelson ..... A47H 1/08 211/105.3
6,913,156 B1 * 7/2005 Wolff ..... A47B 88/975 211/184
D516,901 S 3/2006 Murray
8,505,129 B2 * 8/2013 Parker ..... A47H 1/022 4/610
2008/0202976 A1 8/2008 Burgess
2009/0159541 A1 6/2009 Burgess
2012/0241399 A1 9/2012 Trettin

* cited by examiner

*Primary Examiner* — Devin K Barnett

(57) ABSTRACT

A cylindrical stop assembly for inhibiting a utensil tray from shifting in a drawer includes a sleeve. A first foot is removably attachable to the sleeve to abut an end of a drawer in which the sleeve is positioned. A tube is slidably positioned in the sleeve such that the sleeve and the tube have a telescopic combined length. In this way the sleeve and the tube can extend between the end of a drawer and an end of a utensil tray positioned in the drawer. A second foot is removably attachable to the tube to abut the end of the utensil tray.

5 Claims, 3 Drawing Sheets

CYLINDRICAL STOP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stop devices and more particularly pertains to a new stop device for inhibiting a utensil tray from shifting in a drawer.

(2) Description of Related Art Including Information Disclosed Under 37 CFR 1.97 and 1.98

The prior art relates to stop devices including a spring loaded drawer that includes a divider that is slidably biased in the drawer. The prior art discloses a drawer organization device that includes rods that extend between walls of a drawer and cross members that slidably engage the rods. The prior art discloses a tensioning rod that includes a threaded member therein for lengthening or shortening the tensioning rod. The prior art discloses a storage tray comprising a first portion that slidably engages a second portion thereby facilitating the storage tray to have an adjustable length. The prior art discloses a connector for inhibiting a utensil tray from shifting in a drawer. Additionally, the prior art discloses a variety of curtain rods that have telescopically adjustable lengths.

BRIEF SUMMARY OF THE INVENTION

An embodiment of the disclosure meets the needs presented above by generally comprising a sleeve. A first foot is removably attachable to the sleeve to abut an end of a drawer in which the sleeve is positioned. A tube is slidably positioned in the sleeve such that the sleeve and the tube have a telescopic combined length. In this way the sleeve and the tube can extend between the end of a drawer and an end of a utensil tray positioned in the drawer. A second foot is removably attachable to the tube to abut the end of the utensil tray.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
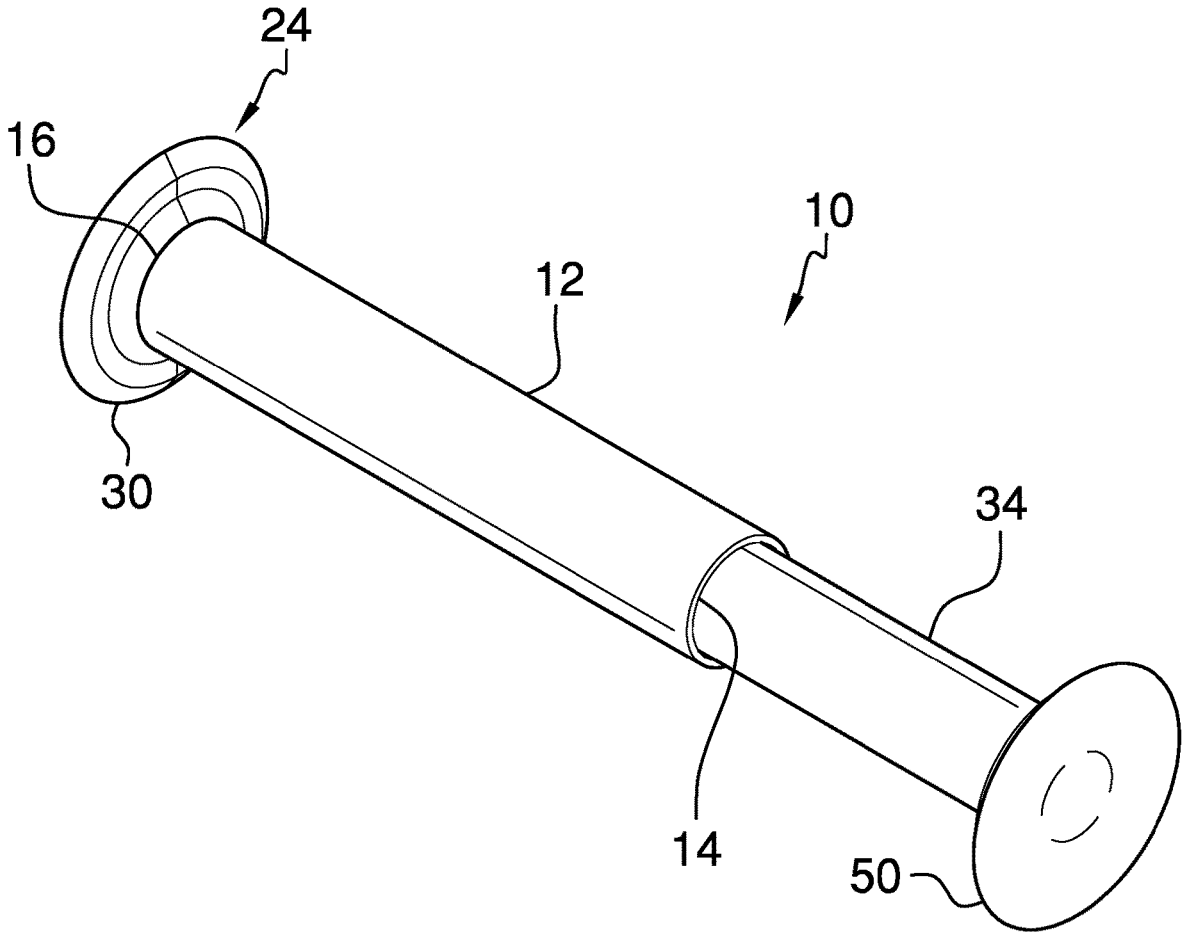
FIG. 1 is a top perspective view of a cylindrical stop assembly according to an embodiment of the disclosure.
Figure 2:
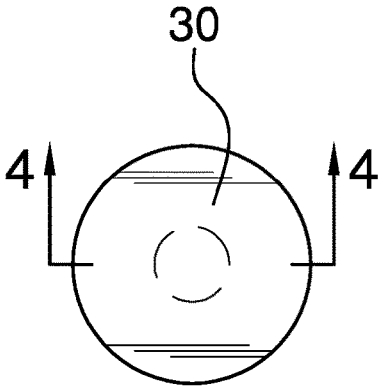
FIG. 2 is a front view of an embodiment of the disclosure.
Figure 3:
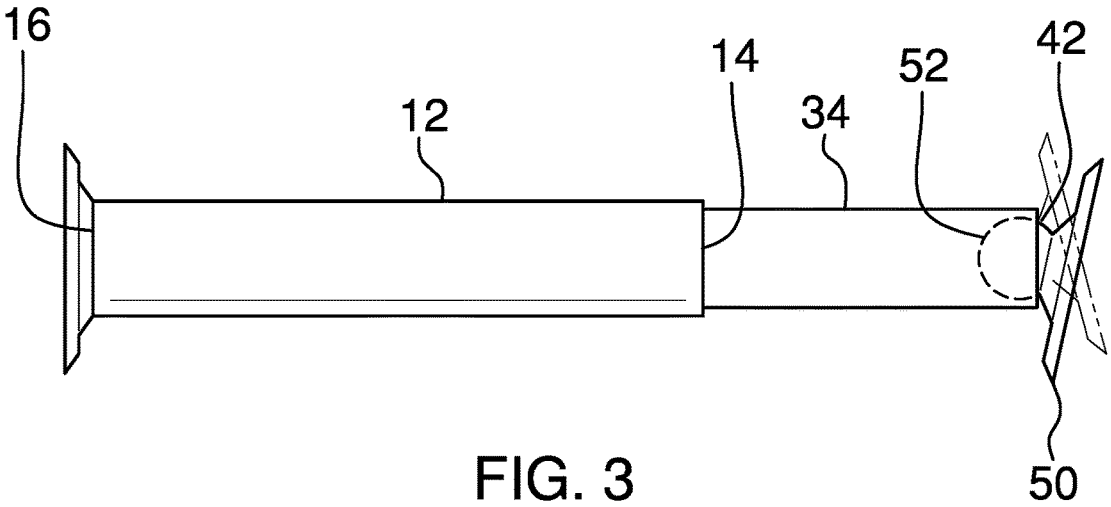
FIG. 3 is a right side phantom view of an embodiment of the disclosure.
Figure 4:
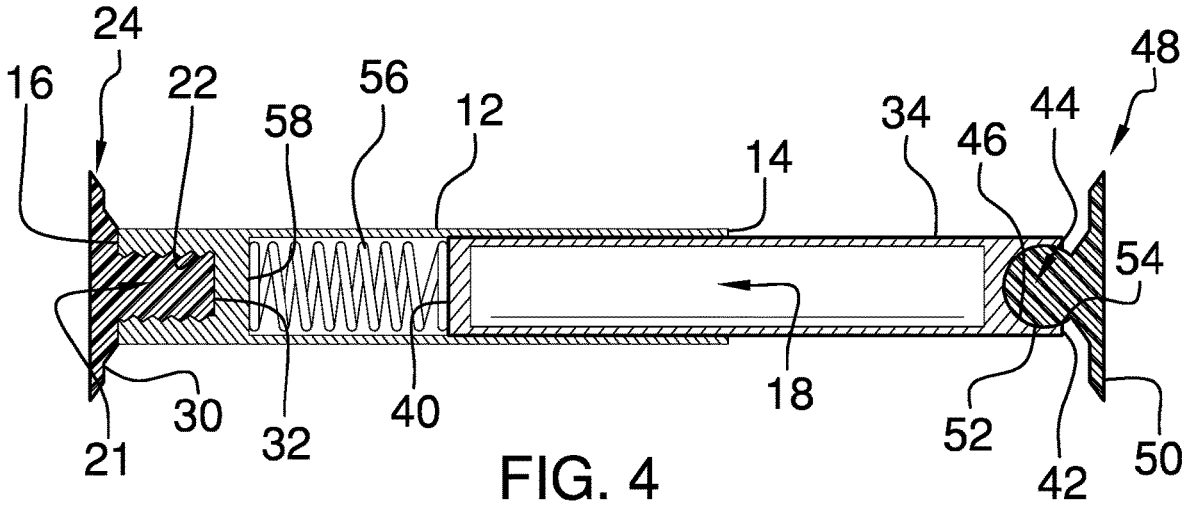
FIG. 4 is a cross sectional view taken along line 4-4 of FIG. 2 of an embodiment of the disclosure.
Figure 5:
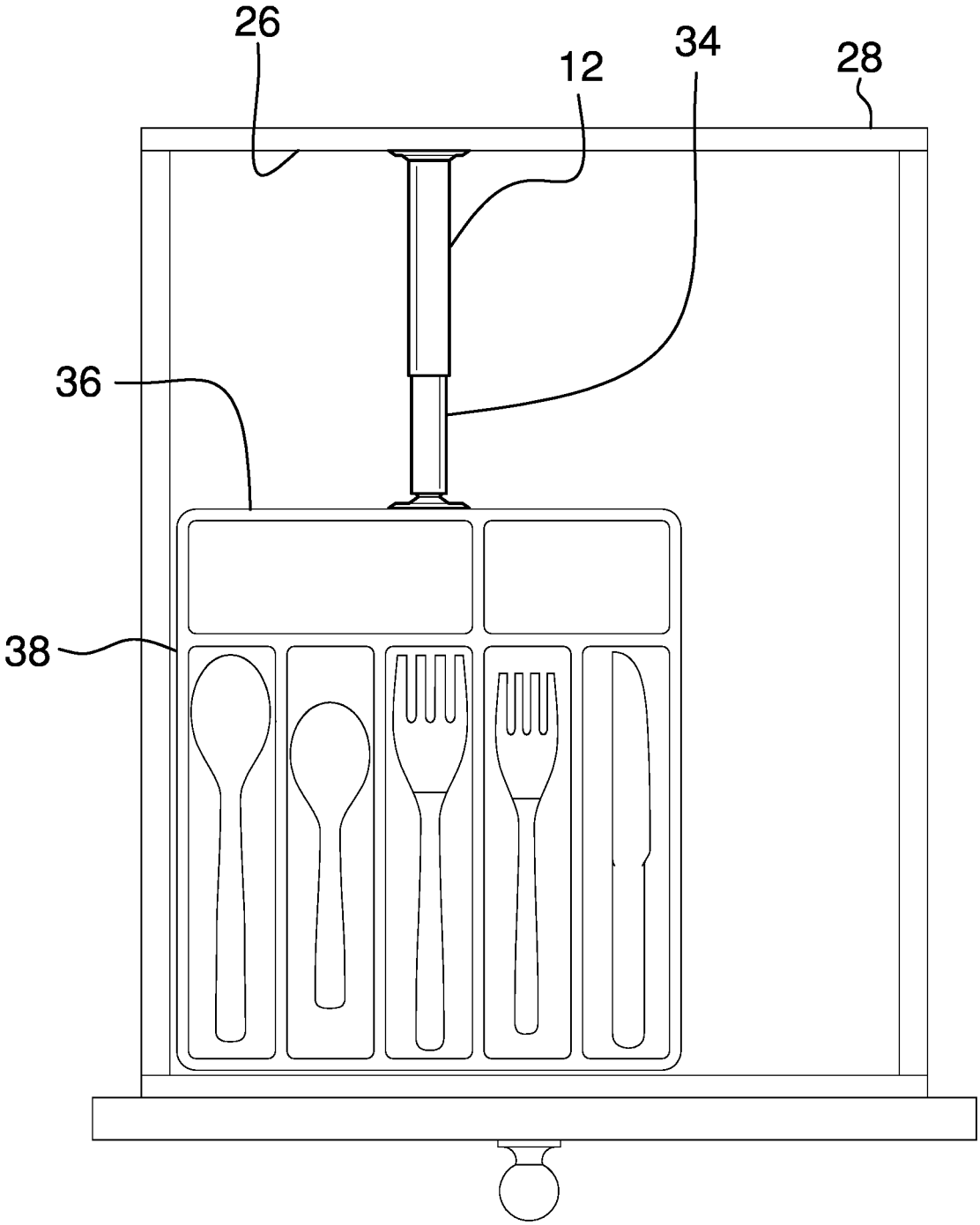
FIG. 5 is a perspective in-use view of an embodiment of the disclosure.

With reference now to the drawings, and in particular to FIGS. 1 through 5 thereof, a new stop device embodying the principles and concepts of an embodiment of the disclosure and generally designated by the reference numeral 10 will be described.

As best illustrated in FIGS. 1 through 5, the cylindrical stop assembly 10 generally comprises a sleeve 12 that has a first end 14 and a second end 16. The first end 14 has a first well 18 extending toward the second end 16 and the second end 16 has a second well 20 extending toward the first end 14. The second well 20 has a bounding surface 22 and the bounding surface 22 is threaded. A first foot 24 is removably attachable to the sleeve 12 to abut an end 26 of a drawer 28 in which the sleeve 12 is positioned. The drawer 28 may be a drawer in a kitchen cabinet or the like. The first foot 24 comprises a disk 30 and a screw 32 extending away from the disk 30 in a perpendicular orientation. The screw 32 threadably engages the bounding surface 22 of the second well 20 such that the disk 30 can be positioned against the end of the drawer 28.

A tube 34 is provided that is slidably positioned in the sleeve 12 such that the sleeve 12 and the tube 34 have a telescopic combined length. In this way the sleeve 12 and the tube 34 can extend between the end 26 of a drawer 28 and an end 36 of a utensil tray 38 positioned in the drawer 28. The utensil tray 38 may be a tray for storing forks, spoons and knives or other similar type of utensil tray. The tube 34 has a primary end 40 and a secondary end 42, and the primary end 40 is positioned in the first well 18. The secondary end 42 has a recess 44 extending toward the primary end 40. The recess 44 has a bounding surface 46 and the bounding surface 46 of the recess 44 is concavely arcuate with respect to the secondary end 42 such that the recess 44 has a spherical shape.

A second foot 48 is removably attachable to the tube 34 wherein the second foot 48 is configured to abut the end of the utensil tray 38. The second foot 48 comprises a disk 50 and a ball 52 that is coupled to the disk 50. The ball 52 is rotatably positioned in the recess 44 in the secondary end 42 of the tube 34 such that the disk 50 of the second foot 48 abuts the end 36 of the utensil tray 38. The ball 52 has an outside diameter that is greater than a diameter of an opening 54 in the recess 44 such that the ball 52 is inhibited from being removed from the recess 44.

A biasing member 56 is provided and the biasing member 56 is positioned between the primary end 40 of the tube 34 and a basal surface 58 of the first well 18 in the sleeve 12. The biasing member 56 biases the tube 34 outwardly from the sleeve 12. The biasing member 56 compresses the sleeve 12 against the end of the drawer 28 and compresses the tube 34 against the end of the utensil tray 38. The biasing member 56 may comprise a spring or other similar type of device.

In use, the sleeve 12 and tube 34 are positioned in the drawer 28 to extend between the end 26 of the drawer 28 and the end 36 of the utensil tray 38. The biasing member 56 biases the tube 34 outwardly from the sleeve 12, thereby compressing the first foot 24 against the drawer 28 and the second foot 48 against the utensil tray 38. In this way the utensil tray 38 is inhibited from shifting when the drawer 28 is opened or closed. The first foot 24 can be threaded outwardly from the sleeve 12 to increase the overall length of the sleeve 12 and tube 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cylindrical stop assembly for engaging a utensil tray in a drawer thereby inhibiting the utensil tray from shifting in the drawer, said assembly comprising:

a sleeve, wherein said sleeve has a first end and a second end, said first end having a first well that extends toward said second end, said second end having a second well that extends toward said first end, said second well having a bounding surface, said bounding surface is threaded;

a first foot that is removably attachable to said sleeve wherein said first foot is configured to abut an end of the drawer in which said sleeve is positioned;

a tube that is slidably positioned in said sleeve such that said sleeve and said tube has a telescopic combined length wherein said sleeve and said tube are configured to extend between the end of the drawer and an end of the utensil tray positioned in the drawer, wherein said tube has a primary end and a secondary end, said primary end is positioned in said first well, wherein said secondary end has a recess that extends toward said primary end, said recess having a bounding surface, said bounding surface of said recess is concavely arcuate with respect to said secondary end such that said recess has a spherical shape; and a second foot that is removably attachable to said tube wherein said second foot is configured to abut the end of the utensil tray, wherein said second foot comprises a disk and a ball that is coupled to said disk, said ball is rotatably positioned in said recess in said secondary end of said tube wherein said disk of said second foot is configured to abut the end of the utensil tray, said ball having an outside diameter that is greater than a diameter of an opening in said recess such that said ball is inhibited from being removed from said recess.

2. The assembly according to claim 1, wherein said first foot comprises a disk and a screw that extends away from said disk of said first foot, said screw threadably engages said bounding surface of said second well wherein said disk of said first foot is configured to be positioned against the end of the drawer.

3. The assembly according to claim 1, further comprising a biasing member that is positioned between said primary end of said tube and a basal surface of said first well in said sleeve, said biasing member is configured to bias said tube outwardly from said sleeve wherein said biasing member is configured to compress said sleeve against the end of the drawer and compress said tube against the end of the utensil tray.

4. A cylindrical stop assembly for engaging a utensil tray in a drawer thereby inhibiting the utensil tray from shifting in the drawer, said assembly comprising:

a sleeve having a first end and a second end, said first end having a first well that extends toward said second end, said second end having a second well that extends toward said first end, said second well having a bounding surface, said bounding surface is threaded;

a first foot that is removably attachable to said sleeve wherein said first foot is configured to abut an end of the drawer in which said sleeve is positioned, said first foot comprising a disk and a screw that extends away from said disk, said screw threadably engages said bounding surface of said second well wherein said disk is configured to be positioned against the end of the drawer;

a tube that is slidably positioned in said sleeve such that said sleeve and said tube has a telescopic combined length wherein said sleeve and said tube are configured to extend between the end of the drawer and an end of a utensil tray positioned in the drawer, said tube having a primary end and a secondary end, said primary end is positioned in said first well, said secondary end having a recess that extends toward said primary end, said recess having a bounding surface, said bounding surface of said recess is concavely arcuate with respect to said secondary end such that said recess has a spherical shape;

a second foot that is removably attachable to said tube wherein said second foot is configured to abut the end of the utensil tray, said second foot comprising a disk and a ball that is coupled to said disk of said second foot, said ball is rotatably positioned in said recess in said secondary end of said tube wherein said disk of said second foot is configured to abut the end of the utensil tray, said ball having an outside diameter that is greater than a diameter of an opening in said recess such that said ball is inhibited from being removed from said recess; and a biasing member that is positioned between said primary end of said tube and a basal surface of said first well in said sleeve, said biasing member is configured to bias said tube outwardly from said sleeve wherein said biasing member is configured to compress said sleeve against the end of the drawer and compress said tube against the end of the utensil tray.

5. A cylindrical foot system for engaging a utensil tray in a drawer thereby inhibiting the utensil tray from shifting in the drawer, said system comprising:

a drawer having a rear end;

a utensil tray that is positioned in said drawer, said utensil tray having a back end;

a sleeve having a first end and a second end, said first end having a first well that extends toward said second end, said second end having a second well that extends toward said first end, said second well having a bounding surface, said bounding surface is threaded;

a first foot that is removably attachable to said sleeve, said first foot abuts said rear end of said drawer, said first foot comprising a disk and a screw that extends away from said disk, said screw threadably engages said bounding surface of said second well such that said disk is positioned against said rear end of said drawer;

a tube that is slidably positioned in said sleeve such that said sleeve and said tube has a telescopic combined length that extends between said rear end of said drawer and said back end of said utensil tray, said tube having a primary end and a secondary end, said primary end is positioned in said first well, said secondary end having a recess that extends toward said primary end, said recess having a bounding surface, said bounding surface of said recess is concavely arcuate with respect to said secondary end such that said recess has a spherical shape;

a second foot that is removably attachable to said tube, said second foot abuts said back end of said utensil tray, said second foot comprising a disk and a ball that is coupled to said disk of said second foot, said ball is rotatably positioned in said recess in said secondary end of said tube such that said disk of said second foot abuts the back end of the utensil tray, said ball having an outside diameter that is greater than a diameter of an opening in said recess such that said ball is inhibited from being removed from said recess; and a biasing member that is positioned between said primary end of said tube and a basal surface of said first well in said sleeve, said biasing member is configured to bias said tube outwardly from said sleeve, said biasing member is configured to compress said sleeve against said rear end of said drawer and compressing said tube against said back end of said utensil tray.

* * * * *